US010102819B2

(12) United States Patent
Ho et al.

(10) Patent No.: US 10,102,819 B2
(45) Date of Patent: Oct. 16, 2018

(54) DRIVING MODULE FOR DISPLAY DEVICE AND RELATED DRIVING METHOD

(71) Applicant: Sitronix Technology Corp., Hsinchu County (TW)

(72) Inventors: Chi-Yang Ho, Hsinchu County (TW); Wen-Yuan Kuo, Hsinchu County (TW)

(73) Assignee: Sitronix Technology Corp., Hsinchu County (TW)

( * ) Notice: Subject to any disclaimer, the term of this patent is extended or adjusted under 35 U.S.C. 154(b) by 70 days.

(21) Appl. No.: 15/156,341

(22) Filed: May 17, 2016

(65) Prior Publication Data

US 2016/0372071 A1 Dec. 22, 2016

Related U.S. Application Data

(60) Provisional application No. 62/182,647, filed on Jun. 22, 2015.

(51) Int. Cl.
*G09G 3/36* (2006.01)

(52) U.S. Cl.
CPC ..... *G09G 3/3677* (2013.01); *G09G 2310/067* (2013.01); *G09G 2310/08* (2013.01); *G09G 2320/0223* (2013.01); *G09G 2320/0233* (2013.01)

(58) Field of Classification Search
CPC .. G09G 3/3677; G09G 3/20; G09G 2310/067; G09G 2310/08; G09G 2320/0223; G09G 2320/0233
See application file for complete search history.

(56) References Cited

U.S. PATENT DOCUMENTS

| | | | | |
|---|---|---|---|---|
| 6,181,317 | B1 * | 1/2001 | Taguchi | G09G 3/3677 345/698 |
| 7,164,405 | B1 * | 1/2007 | Jeong | G09G 3/3688 345/94 |
| 7,233,323 | B2 * | 6/2007 | Watsuda | G09G 3/3677 345/204 |
| 8,022,919 | B2 * | 9/2011 | Kwon | G09G 3/3677 345/100 |
| 9,013,386 | B2 | 4/2015 | Tsai | |
| 2003/0038766 | A1 * | 2/2003 | Lee | G09G 3/3648 345/87 |

(Continued)

FOREIGN PATENT DOCUMENTS

| | | | |
|---|---|---|---|
| CN | 1741118 | A | 3/2006 |
| CN | 100380419 | C | 4/2008 |

(Continued)

*Primary Examiner* — Nalini Mummalaneni
(74) *Attorney, Agent, or Firm* — Winston Hsu

(57) ABSTRACT

A driving module for a display device includes a first driving unit, for generating a plurality of data driving signals to a plurality of data lines of the display device according to a first control signal; and a control unit, for generating the first control signal to the first driving unit and a second control signal to a second driving unit of the display device; wherein the control unit controls the second driving unit to generate a plurality of gate driving signals to a plurality of scan lines of the display device via the second control signal, and durations of a plurality of gate enable periods in the plurality of gate driving signals are different.

18 Claims, 5 Drawing Sheets

(56) References Cited

U.S. PATENT DOCUMENTS

| | | | | |
|---|---|---|---|---|
| 2004/0189583 | A1* | 9/2004 | Park | G09G 3/3677 345/100 |
| 2008/0309597 | A1* | 12/2008 | Nam | G09G 3/3677 345/87 |
| 2009/0184913 | A1* | 7/2009 | Sato | G09G 3/3648 345/99 |
| 2014/0085274 | A1* | 3/2014 | Lewis | G09G 3/3433 345/204 |

FOREIGN PATENT DOCUMENTS

| | | | |
|---|---|---|---|
| CN | 101197110 | A | 6/2008 |
| CN | 101329851 | A | 12/2008 |
| CN | 101499233 | A | 8/2009 |
| TW | 444184 | | 7/2001 |
| TW | 200719066 | | 5/2007 |
| TW | 201040916 | A1 | 11/2010 |
| TW | 201112216 | A1 | 4/2011 |
| TW | I340959 | | 4/2011 |
| TW | 201241810 | A1 | 10/2012 |
| TW | I376675 | | 11/2012 |

* cited by examiner

DRIVING MODULE FOR DISPLAY DEVICE AND RELATED DRIVING METHOD

CROSS REFERENCE TO RELATED APPLICATIONS

This application claims the benefit of U.S. Provisional Application No. 62/182,647 filed on Jun. 22, 2015, the contents of which are incorporated herein in their entirety.

BACKGROUND OF THE INVENTION

1. Field of the Invention

The present invention relates to a driving module for a display device and related driving method, and more particularly, to a driving module capable of adjusting enable periods of driving signals based on loading magnitudes and related driving method.

2. Description of the Prior Art

A liquid crystal display (LCD) is a flat panel display which has the advantages of low radiation, light weight and low power consumption and is widely used in various information technology (IT) products, such as notebook computers, personal digital assistants (PDA), and mobile phones. An active matrix thin film transistor (TFT) LCD is the most commonly used transistor type in LCD families, and particularly in the large-size LCD family. A driving system installed in the LCD includes a timing controller, source drivers and gate drivers. The source and gate drivers respectively control data lines and scan lines, which intersect to form a cell matrix. Each intersection is a cell including crystal display molecules and a TFT. In the driving system, the gate drivers are responsible for transmitting scan signals to gates of the TFTs to turn on the TFTs on the panel. The source drivers are responsible for converting digital image data, sent by the timing controller, into analog voltage signals and outputting the voltage signals to sources of the TFTs. When a TFT receives the voltage signals, a corresponding liquid crystal molecule has a terminal whose voltage changes to equalize the drain voltage of the TFT, which thereby changes its own twist angle. The rate that light penetrates the liquid crystal molecule is changed accordingly, allowing different colors to be displayed on the panel.

According to different applications and design concepts, different electronic products may adopt different circuit configurations when installing the LCD. Under such a condition, loadings of circuit units in the LCD change with the circuit configuration and accordingly effect the operations of the driving system. Thus, how to adjust the driving system according to the circuit configuration to reduce effects of loading variations among the circuit units becomes a topic to be discussed.

SUMMARY OF THE INVENTION

In order to solve the above issue, the present invention provides a driving module capable of adjusting enable periods of driving signals based on loading magnitudes and related driving method.

In an aspect, the present invention discloses a driving module for a display device. The driving module comprises a first driving unit, for generating a plurality of data driving signals to a plurality of data lines of the display device according to a first control signal; and a control unit, for generating the first control signal to the first driving unit and a second control signal to a second driving unit of the display device; wherein the control unit controls the second driving unit to generate a plurality of gate driving signals to a plurality of scan lines of the display device via the second control signal, and durations of a plurality of gate enable periods in the plurality of gate driving signals are different.

In another aspect, the present invention discloses a driving method for a driving module of a display device. The driving method comprises generating a plurality of gate driving signals to a plurality of scan lines of the display device; wherein durations of a plurality of gate enable periods in the plurality of gate driving signals are different.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
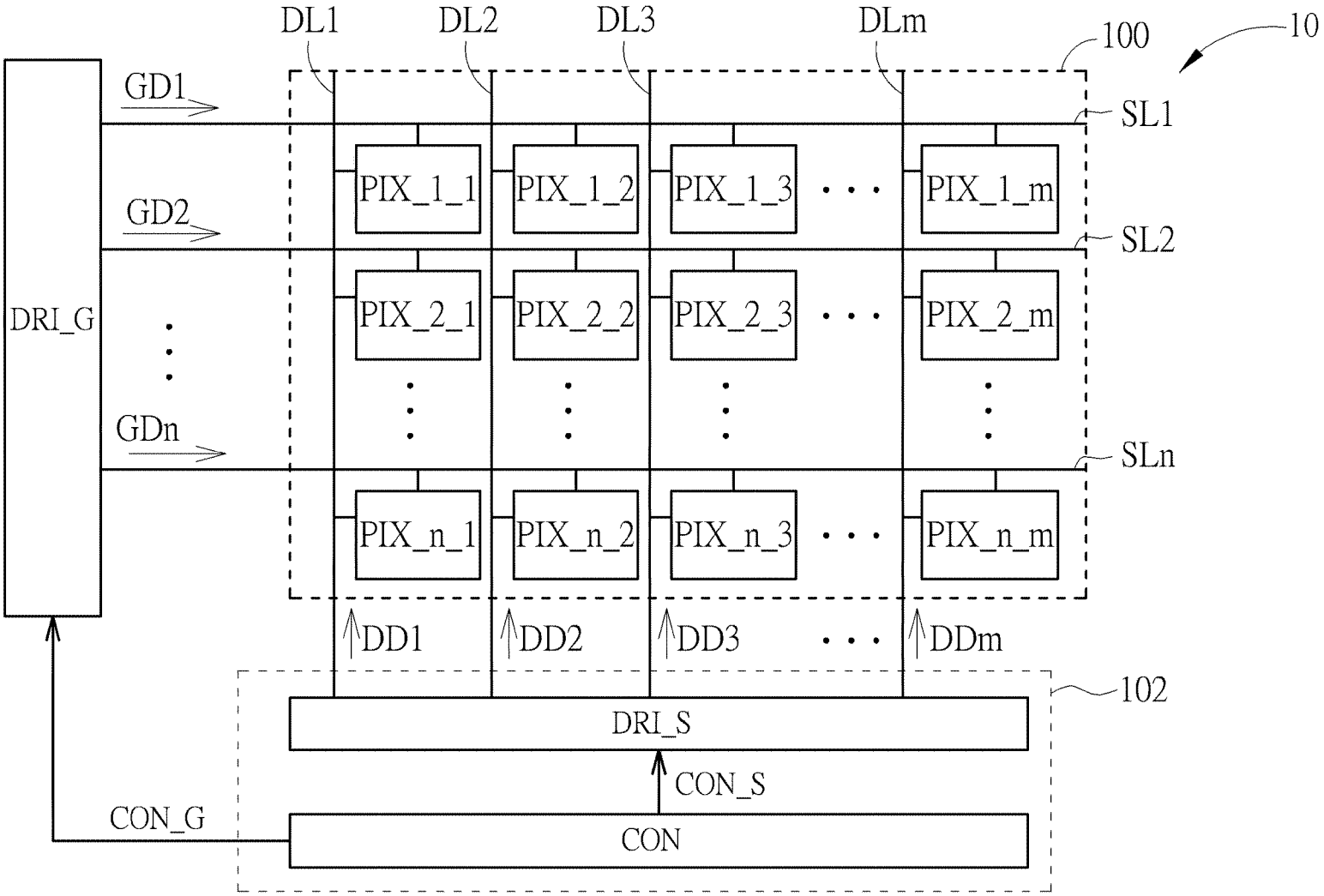
FIG. 1 is a schematic diagram of a display device according to an example of the present invention

Please refer to FIG. 1, which is a schematic diagram of a display device 10 according to an example of the present invention. The display device 10 may be an electronic device with display panel, such as a smart phone, a tablet, or a laptop. The detailed structure of the display device 10 changes according to different applications. FIG. 1 only shows a panel 100, a driving module 102 and a driving unit DRI_G of the display device 10 for illustrations and other circuits not directly related to the concept of the present disclosure (e.g. housing and connection interface) are omitted for brevity. The panel 100 comprises scan lines SL1-SLn, data lines DL1-DLm, wherein each intersection between one of the scan lines SL1-SLn and one of the data line DL1-DLm is coupled to one of pixels PIX_1_1-PIX_m_n. Operation principles of the panel 100 should be well-known to those with ordinary skill in the art and are not narrated herein for brevity. The driving module 102 comprises a control unit CON and a driving unit DRI_S. The control unit CON is utilized to generate control signals CON_G and CON_S. The driving unit DRI_S is utilized to generate data driving signals DD1-DDm according to the driving signal CON_S, to drive the data lines DL1-DLm. The driving unit DRI_G is utilized to generate gate driving signals GD1-GDn according to the driving signal CON_G, to drive scan lines SL1-SLn. Because of differences between traces in the display device 10, the loadings of the pixels PIX_1_1-PIX_1_m located at the first row are greater than those of the pixels PIX_n_1-PIX_n_m to the driving unit DRI_S. In order to avoid the different loadings make the panel 100 operate abnormally, the control unit CON adjusts the gate driving signals GD1-GD n via the control signal CON_G, to change durations of gate enable periods TG1-TGn at which the gate driving signals GD1-GDn enables the scan lines SL1-SLn.

In details, the control unit CON adjusts the durations of the gate enable periods TG1-TGn at which the gate driving signals GD1-GDn enables the scan lines SL1-SLn via the control signal CON_G, to make the durations of the gate enable periods TG1-TGn of the gate driving signals GD1-GDn have different values. In an example, the control unit CON adjusts the duration of each of the gate enable periods TG1-TGn of the gate driving signals GD1-GDn according to a distance between the driving unit DRI_S and corresponded scan line among the scan lines SL1-SLn. In this example, the durations of each of the gate enable periods TG1-TGn of the gate driving signals GD1-GDn is proportional to the distance between the driving unit DRI_S and corresponded scan line among the scan lines SL1-SLn, respectively. For example, the duration of the gate enable period TG1 of the gate driving signal GD1 is proportional to the distance between the scan line SL1 and the driving unit DRI_S, the duration of the gate enable period TG2 of the gate driving signal GD2 is proportional to the distance between the scan line SL2 and the driving unit DRI_S, and so on. As a result, the control unit CON reduces effects of the loading variations generated by the trace configurations.

In an example, a sum of the durations of the gate enable periods TG1-TGn in the gate driving signal GD1-GDn within a frame is equaled to a constant CHT satisfied system specifications. That is, the control unit CON has to shrink at least one of gate enable periods TG1-TGn when prolonging one of the gate enable periods TG1-TGn, to make the sum of the durations of the gate enable periods TG1-TGn remain the constant CHT. According to different applications and design concepts, the sum of the durations of the gate enable periods TG1-TGn may be appropriately altered. In an example, the sum the durations of the gate enable periods TG1-TGn is within ±5% range of the constant CHT (i.e. 0.95×CHT≤duratuibs' sum of TG1-TGn≤1.05×CHT) when each of the scan lines SL1-SLn is drove once. In another example, the sum the durations of the gate enable periods TG1-TGn is within ±20% range of the constant CHT (i.e. 0.8×CHT≤durations' sum of TG1-TGn 1.2×CHT) .

In an example, the constant CHT is the sum of the times at which the scan lines SL1-SL1 in the panel 100 are enabled. For example, the constant CHT is 1/60 seconds when a refreshing rate of the panel 100 is 60 Hz. In another example, the constant CHT is smaller than 1/60 seconds when the refreshing rate of the panel 100 is 60 Hz, to guarantee that the display device 100 normally operates. In this example, the designer defines an active area AA comprising the scan lines SL1-SLn and further defines a blanking area BA comprising a plurality of virtual scan lines (not shown in FIG. 1). Next, 1/60 seconds is divided to the active area AA and the blanking area BA (i.e. to the scan lines SL1-SLn and the virtual scan lines). For example, if a resolution of the panel is 800*480 (i.e. a number of scan lines SL1-SLn in the active area AA is 480), the refreshing rate is 60 Hz, and the blanking area comprises 26 virtual scan lines, the constant CHT becomes 1/60×480/480+26 seconds. According to different applications and design concepts, the constant CHT may be appropriately changed.

In an example, the control unit CON changes durations of data enable periods TD1-TDm in the data signal DD1-DDm according to adjustments of the durations of the gate enable period TG1-TGn of the gate driving signal GD1-GDn. For example, the durations of the data enable periods TD1-TDm of the data signal DD1-DDm are adjusted to be smaller than or equaled to the duration of the gate enable period TG1 of the gate driving signal GD1 when the control unit CON controls the driving unit DRI_S to generate the data driving signal DD1-DDm corresponding to the scan line SL1; the durations of the data enable periods TD1-TDm of the data signal DD1-DDm are adjusted to be smaller than or equaled to the duration of the gate enable period TG2 of the gate driving signal GD2 when the control unit CON controls the driving unit DRI_S to generate the data driving signal DD1-DDm corresponding to the scan line SL2; and so on. Under such a condition, the control unit CON ensures that the panel 100 receives correct data voltages.

Figure 2:
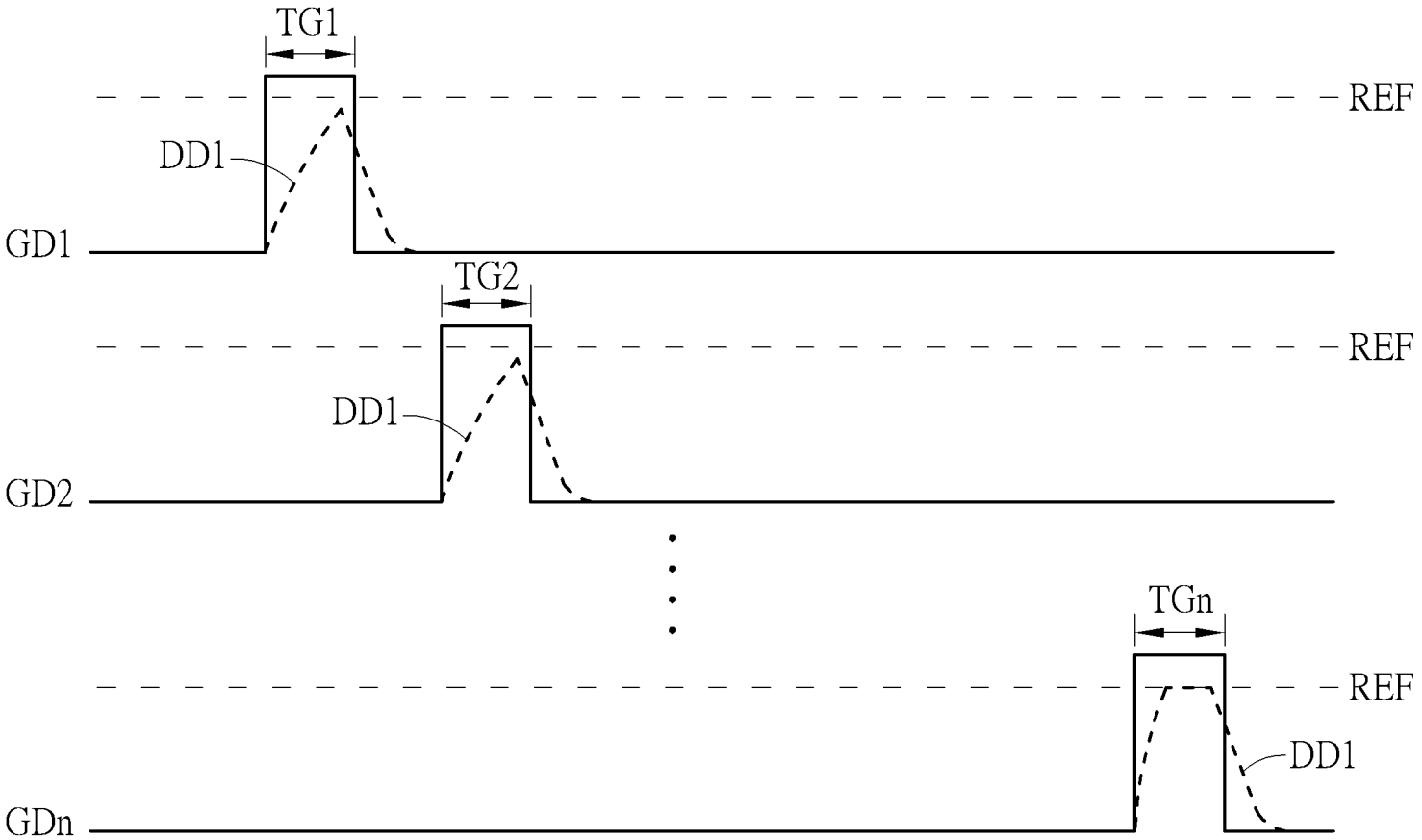
FIG. 2 is a schematic diagram of related signals of the display device shown in FIG. 1.

Please refer to FIG. 2, which is a schematic diagram of related signals in the display device 10 shown in FIG. 1. In FIG. 2, target voltages of the data driving signal DD1 on the scan lines SL1-SLn are a voltage REF. In addition, the control unit CON does not adjust the durations of the gate enable periods TG1-TGn of the gate driving signals GD1-GDn in this example. That is, the durations of the gate enable periods TG1-TGn of the gate driving signals GD1-GDn are the same. Because of the loading variations generated by the trace length differences, the data driving signal DD1 cannot make a voltage received by the pixel at the intersection of the scan line SL1 and the data line DL1 reach the voltage REF before the gate enable period TG1 ends. Similarly, the data driving signal DD1 cannot make a voltage received by the pixel at the intersection of the scan line SL2 and the data line DL1 reach the voltage REF before the gate enable period TG2 ends. In comparison, the data driving signal DD1 is able to make a voltage received by the pixel at the intersection of the scan line SLn and the data line DL1 rapidly reach the voltage REF in the gate enable period TGn. Under such a condition, the operations of the display device 10 are effected by the loading variations generated by the trace length differences.

Figure 3:
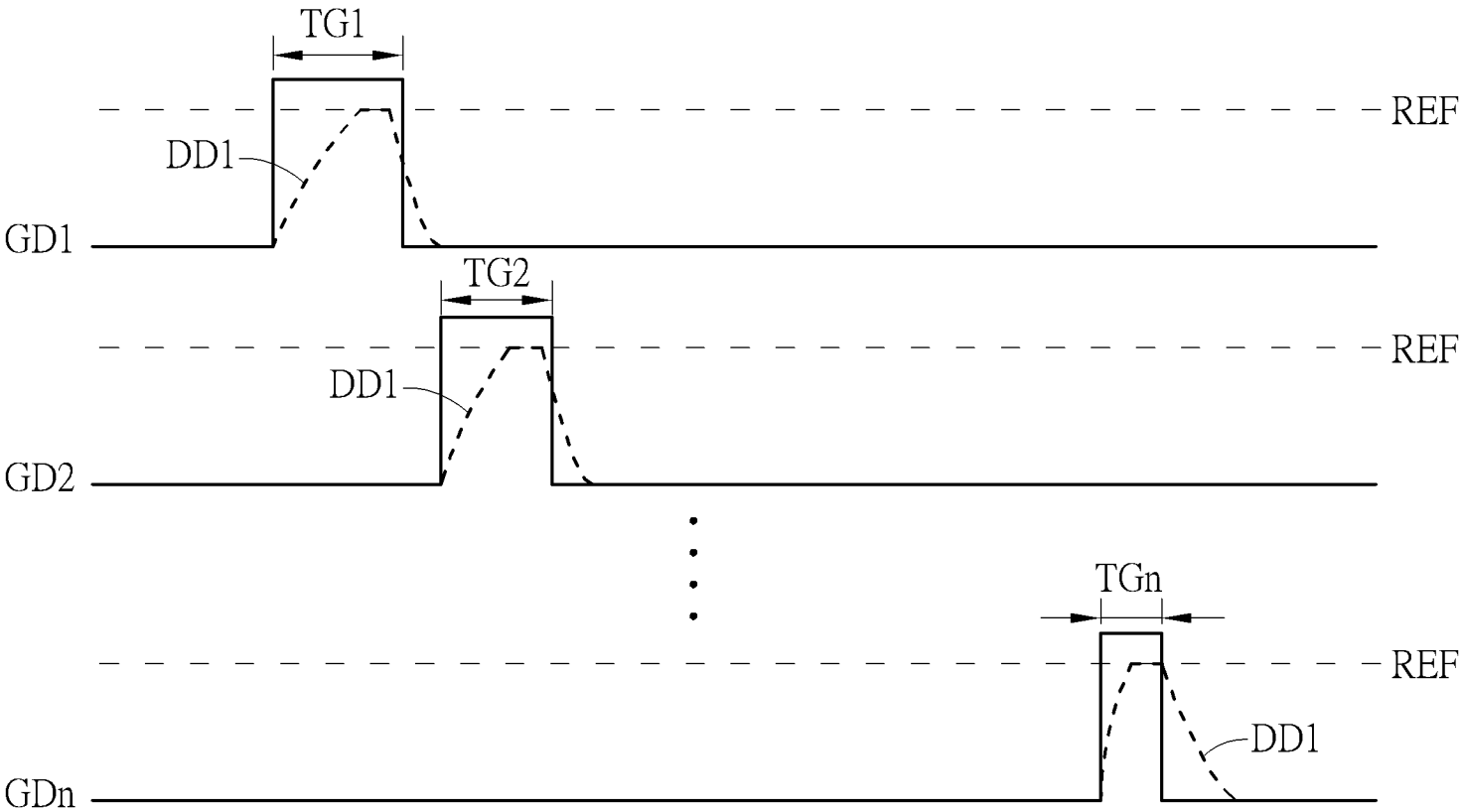
FIG. 3 is a schematic diagram of related signals of the display device shown in FIG. 1.

Please refer to FIG. 3, which is a schematic diagram of related signals in the display device 10 shown in FIG. 1. In FIG. 3, the target voltages of the data driving signal DD1 on the scan lines SL1-SLn are the voltage REF. In this example, the control unit CON adjusts the duration of each of gate enable periods TG1-TGn of the gate driving signal GD1-GDn according to the distance between the driving unit DRI_S and corresponded scan line among the scan lines SL1-SLn. The duration of each of the gate enable periods TG1-TGn of the gate driving signal GD1-GDn is proportional to the distances between the driving unit DRI_S and each of the scan lines SL1-SLn, respectively. Under such a condition, the data driving signal DD1 is able to reach the voltage REF in each of the gate enable period TG1-TGn. The effects of the loading variations generated by the trace length differences are accordingly eliminated.

In the above examples, the control unit CON adjusts the durations of the gate enable periods TG1-TGn at which the gate driving signal GD1-GDn generated by the driving unit DRI_G enables the scan lines DL1-DLn via the control signal CON_G, to eliminate the effects of the loading variations generated by the trace length differences. According to different applications and modifications, those with ordinary skill in the art may observe appropriate alternations and modifications. For example, the durations of the gate enable periods TG1-TGn are different from each other after adjusted by the control unit CON. In another example, the gate driving signals GD1-GDn are classified into gate driving signal groups GDG1-GDGi. The durations of the gate enable periods of the gate driving signals in the same gate driving signal group are the same and the durations of the gate enable periods of the gate driving signals in different gate driving signal groups are different. In other words, the gate driving signals corresponding to the scan lines having similar distances with the driving unit DRI_S have the gate enable periods of the same duration.

Figure 4:
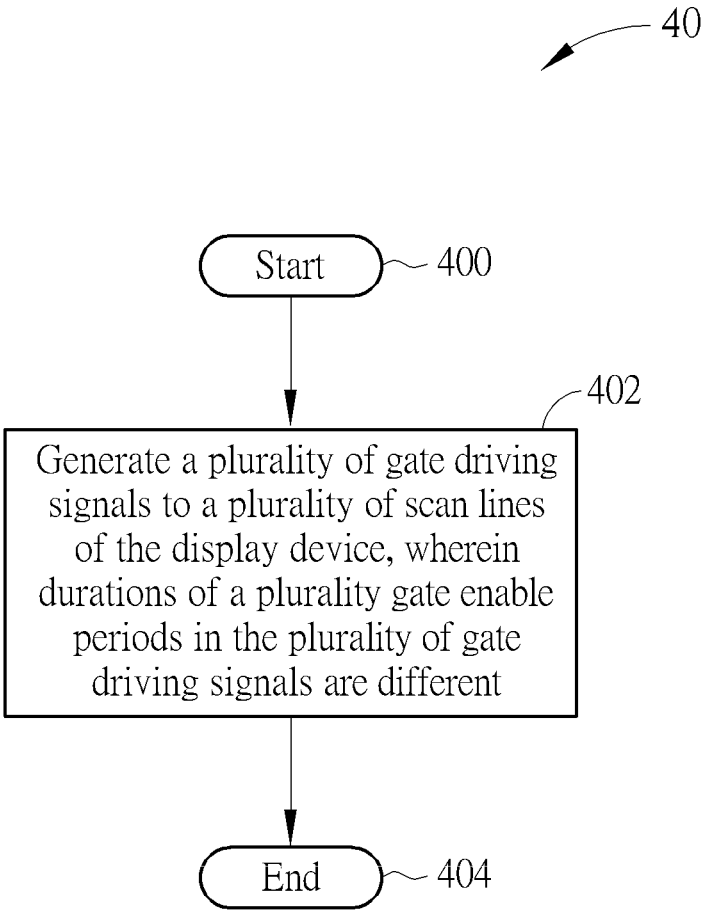
FIG. 4 is a flowchart of a driving method according to an example of the present invention.

The process of the control unit CON adjusting the durations of the gate enable periods TG1-TGn at which the gate driving signals GD1-GDn enables the scan lines SL1-SLn can be summarized into a driving method 40 shown in FIG. 4. The driving method 40 is utilized in a driving module of a display device (e.g. an electronic device with a display panel, such as a smart phone, a tablet, and a laptop) and comprises the following steps:

Step 400: Start.

Step 402: Generate a plurality of gate driving signals to a plurality of scan lines of the display device, wherein durations of a plurality gate enable periods in the plurality of gate driving signals are different.

Step 404: End.

According to the driving method 40, the driving module generates a plurality of the gate driving signals to a plurality of scan lines of the display device. For example, the driving module controls a first driving unit of the display device to generate the plurality of gate driving signals via a control signal. Note that, durations of a plurality of gate enable periods in the plurality of gate driving signals are different. In an example, a sum of the durations of the plurality of gate enable periods in the plurality of gate driving signals is equaled to a constant satisfied system specification. In another example, the duration of each of the plurality of gate enable periods in the plurality of gate driving signals is proportional to a distance between a second driving unit and corresponded scan line among the plurality of scan lines coupled to the gate driving signals, wherein the second driving unit is utilized to generate a plurality of data driving signals to a plurality of data lines of the display device. When the second driving unit generates a plurality of data driving signals corresponding to a first scan line among the plurality of scan lines, durations of a plurality of data enable periods in the plurality of data driving signals are proportional to the duration of the gate enable period in a first gate driving signal of the first scan line.

In an example, the duration of each of the gate enable periods is different from that of each other of the gate enable periods. In another example, the plurality of gate driving signals are classified into a plurality of gate driving signal groups. The durations of the gate enable periods of the gate driving signals in the same gate driving signal group are the same and the durations of the gate enable periods of the gate driving signals in different gate driving signal groups are different. The detailed operation principles of the driving method 40 can be referred to the above and are not narrated herein for brevity.

Figure 5:
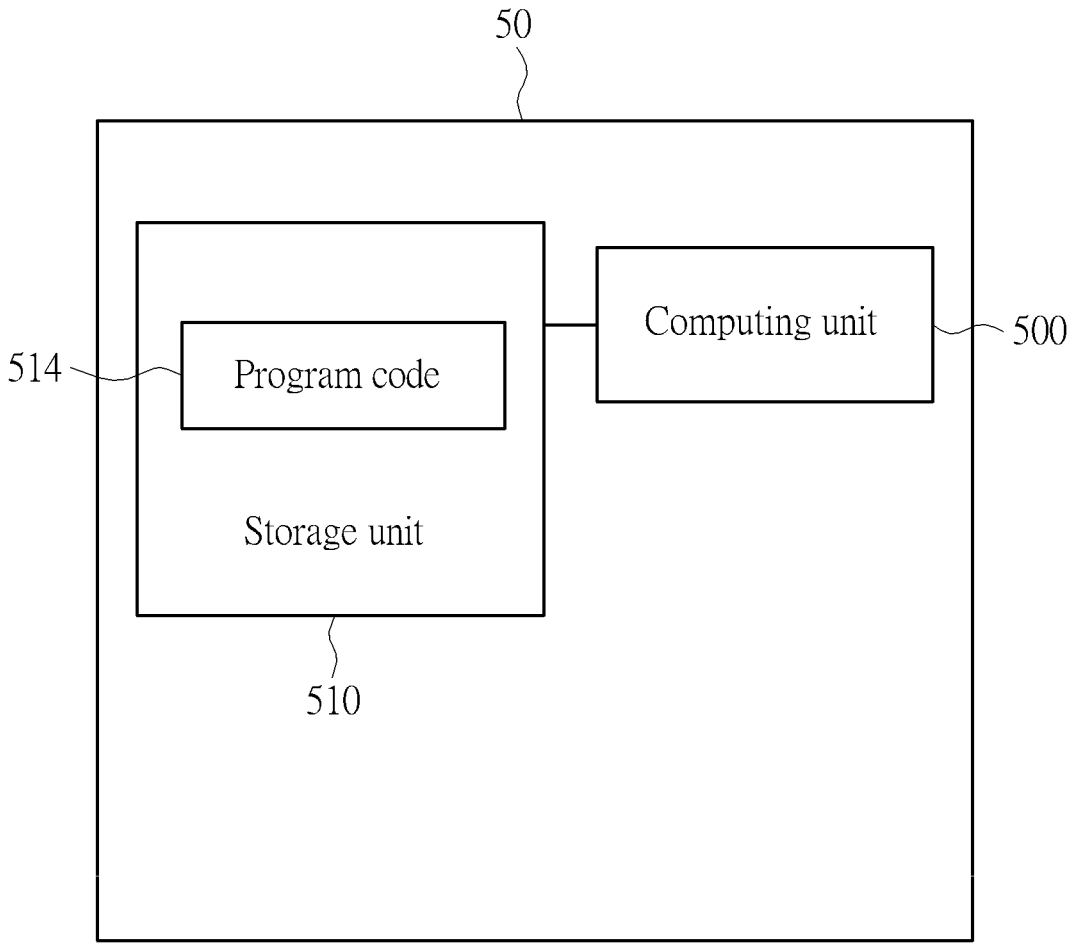
FIG. 5 is a schematic diagram of a driving module according to an example of the present invention.

According to different applications and design concepts, the driving module 102 may be realized in various methods. Please refer to FIG. 5, which is a schematic diagram of a driving module 50 according to an example of the present invention. The driving module 50 is utilized in a display device and comprises a computing unit 500, a storage unit 510. The computing unit 500 may be a microprocessor, an Application Specific Integrated Circuit (ASIC), etc. The storage unit 510 maybe any data storage device that can store a program code 514 and is accessible by the computing unit 500. Examples of the storage unit 510 include, but are not limited to, a subscriber identity module (SIM), read-only memory (ROM), flash memory, random-access memory (RAM), CD-ROM/DVD-ROM, magnetic tape, hard disk, and an optical data storage device.

In an example, the driving method 40 is compiled into the program code 514 and the driving module 50 performs the steps 400-404 according to the program code 514 to generate driving signals utilized for driving the display panel.

To sum up, the driving module of the above examples eliminates the effects of the loading variations generated by the trace length differences by adjusting the durations of the gate enable periods at which the gate driving signals enables the scan lines. After adjusted by the driving module, the sum of the durations of the gate enable periods at which the gate driving signals enables the scan lines remains a constant. In addition, the driving module correspondingly adjusts the durations of the data enable periods of the data driving signals, to drive the display panel normally.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A driving module for a display device, comprising:

a first driving unit, for generating a plurality of data driving signals to a plurality of data lines of the display device according to a first control signal; and a control unit, for generating the first control signal to the first driving unit and a second control signal to a second driving unit of the display device;

wherein the control unit controls the second driving unit to generate a plurality of gate driving signals to a plurality of scan lines of the display device via the second control signal, durations of a plurality of gate enable periods in the plurality of gate driving signals are different, and a sum of the durations of the plurality of gate enable periods in the plurality of gate driving signals within a frame is equaled to a constant;

wherein the constant is determined according to a relationship between a refreshing rate of the display device and a number of the plurality of scan lines.

2. The driving module of claim 1, wherein durations of a plurality of data enable periods in the plurality of data driving signals corresponding to a first scan line among the plurality of scan lines are proportional to a duration of a gate enable period of a first gate driving signal of the first scan line.

3. The driving module of claim 1, wherein the plurality of gate driving signals are classified into a plurality of gate driving signal groups, the durations of the gate enable periods of the gate driving signals in the same gate driving signal group are the same, and the durations of the gate enable periods of the gate driving signals in different gate driving signal groups are different.

4. The driving module of claim 1, wherein the duration of the gate enable periods in each of the plurality of gate driving signals are proportional to a distance between the first driving unit and the scan line coupled to each of the plurality of gate driving signals.

5. A driving module for a display device, comprising:

a first driving unit, for generating a plurality of data driving signals to a plurality of data lines of the display device according to a first control signal; and a control unit, for generating the first control signal to the first driving unit and a second control signal to a second driving unit of the display device;

wherein the control unit controls the second driving unit to generate a plurality of gate driving signals to a plurality of scan lines of the display device via the second control signal, durations of a plurality of gate enable periods in the plurality of gate driving signals are different, and a sum of the durations of the plurality of gate enable periods in the plurality of gate driving signals within a frame is equaled to a constant;

wherein the constant is determined according to a relationship among a refreshing rate of the display device, a number of the plurality of scan lines, and a number of a plurality of virtual scan lines.

6. The driving module of claim 5, wherein the duration of the gate enable periods in each of the plurality of gate driving signals are proportional to a distance between the first driving unit and the scan line coupled to each of the plurality of gate driving signals.

7. The driving module of claim 5, wherein durations of a plurality of data enable periods in the plurality of data enable signals corresponding to a first scan line among the plurality of scan lines are proportional to a duration of a gate enable period of a first gate driving signal of the first scan line.

8. The driving module of claim 5, wherein the plurality of gate driving signals are classified into a plurality of gate driving signal groups, the durations of the gate enable periods of the gate driving signals in the same gate driving signal group are the same, and the durations of the gate enable periods of the gate driving signals in different gate driving signal groups are different.

9. A driving method for a driving module of a display device, comprising:

generating a plurality of gate driving signals to a plurality of scan lines of the display device; and generating a plurality of data driving signal to a plurality of data lines of the display device;

wherein durations of a plurality of gate enable periods in the plurality of gate driving signals are different, the plurality of data driving signals are generated according to the plurality of gate driving signals, and a sum of the durations of the plurality of gate enable periods in the plurality of gate driving signals within a frame is equaled to a constant;

wherein the constant is determined according to a relationship between a refreshing rate of the display device and a number of the plurality of scan lines.

10. The driving method of claim 9, further comprising:

generating a plurality of data driving signals of a first scan line among the plurality of scan lines to a plurality data lines of the display device;

wherein durations of a plurality of data enable periods in the plurality of data driving signals are proportional to the duration of the gate enable period in a first gate driving signal of the plurality of gate driving signals corresponding to the first scan line.

11. The driving method of claim 9, wherein the plurality of gate driving signals are classified into a plurality of gate driving signal groups, the durations of the gate enable periods of the gate driving signals in the same gate driving signal group are the same, and the durations of the gate enable periods of the gate driving signals in different gate driving signal groups are different.

12. The driving method of claim 9, wherein the step of generating the plurality of gate driving signals to the plurality of scan lines of the display device comprises:

controlling a driving unit of the display device to generate the plurality of gate driving signals to the plurality of scan lines of the display device.

13. The driving method of claim 9, wherein the duration of each gate enable period in each gate driving signal is proportional to a distance between the driving unit and the corresponded scan line coupled to each gate driving signal.

14. A driving method for a driving module of a display device, comprising:

generating a plurality of gate driving signals to a plurality of scan lines of the display device; and generating a plurality of data driving signal to a plurality of data lines of the display device;

wherein durations of a plurality of gate enable periods in the plurality of gate driving signals are different, the plurality of data driving signals are generated according to the plurality of gate driving signals, and a sum of the durations of the plurality of gate enable periods in the plurality of gate driving signals within a frame is equaled to a constant;

wherein the constant is determined according to a relationship among a refreshing rate of the display device, a number of the plurality of scan lines, and a number of a plurality of virtual scan lines.

15. The driving method of claim 14, wherein the step of generating the plurality of gate driving signals to the plurality of scan lines of the display device comprises:

controlling a driving unit of the display device to generate the plurality of gate driving signal to the plurality of scan lines of the display device.

16. The driving method of claim 14, wherein the duration of each gate enable period in each gate driving signal is proportional to a distance between the driving unit and the corresponded scan line coupled to each gate driving signal.

17. The driving method of claim 14, further comprising:

generating a plurality of data driving signals of a first scan line among the plurality of scan lines to a plurality data lines of the display device;

wherein durations of a plurality of data enable periods in the plurality of data driving signals are proportional to the duration of the gate enable period in a first gate driving signal of the plurality of gate driving signals corresponding to the first scan line.

18. The driving method of claim 14, wherein the plurality of gate driving signals are classified into a plurality of gate driving signal groups, the durations of the gate enable periods of the gate driving signals in the same gate driving signal group are the same, and the durations of the gate enable periods of the gate driving signals in different gate driving signal groups are different.

* * * * *